US008290554B2

(12) United States Patent
Bittner

(10) Patent No.: US 8,290,554 B2
(45) Date of Patent: Oct. 16, 2012

(54) CRYOSTAT FOR SUPERCONDUCTING MR MAGNETS

(75) Inventor: Gerhard Bittner, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 729 days.

(21) Appl. No.: 12/503,940

(22) Filed: Jul. 16, 2009

(65) Prior Publication Data

US 2010/0022395 A1 Jan. 28, 2010

(30) Foreign Application Priority Data

Jul. 16, 2008 (DE) ..... 10 2008 033 467

(51) Int. Cl.
*H01F 6/06* (2006.01)
*F25D 3/10* (2006.01)

(52) U.S. Cl. ..... 505/163; 62/51.1; 62/129; 335/216; 324/248; 324/318

(58) Field of Classification Search ..... 505/163; 62/51.1, 129; 335/216; 324/248, 318
See application file for complete search history.

(56) References Cited

U.S. PATENT DOCUMENTS

| | | | | |
|---|---|---|---|---|
| 5,379,600 | A * | 1/1995 | Moritsu et al. | 62/47.1 |
| 5,936,499 | A * | 8/1999 | Eckels | 335/216 |
| 2006/0230769 | A1* | 10/2006 | Nogami | 62/129 |
| 2009/0273776 | A1* | 11/2009 | Bittner | 356/240.1 |

FOREIGN PATENT DOCUMENTS

JP 11257770 9/1999

* cited by examiner

*Primary Examiner* — Stanley Silverman
*Assistant Examiner* — Kallambella Vijayakumar
(74) *Attorney, Agent, or Firm* — Schiff Hardin LLP

(57) ABSTRACT

A cryostat has a tank for accommodation of a coolant and at least one superconducting magnet coil to generate a magnetic field. The tank has on a top side at least one tower pipe for filling the coolant and/or for venting vaporized coolant. In order to immediately indicate if and when sealing of filling pipes and discharging pipes with (for example) ice has occurred, a pressure sensor is connected via a pressure sensor pipe with the inside of the tank.

7 Claims, 2 Drawing Sheets

CRYOSTAT FOR SUPERCONDUCTING MR MAGNETS

BACKGROUND OF THE INVENTION

1. Field of the Invention

The present invention concerns a cryostat for an MR magnet for medical magnetic resonance (MR) imaging.

2. Description of the Prior Art

Superconducting magnetic coils are used in medical imaging in magnetic resonance tomography (MRT) apparatuses. The superconducting magnetic coils are cooled with liquid helium. If the superconducting magnet coils are suddenly transitioned into the normally-conducting state ("quench"), the energy of the magnetic field is transduced into heat. The liquid helium is thereby vaporized and large quantities of cold helium gas must be safely conducted to the atmosphere. For this purpose, an opening is provided on the top of the tank in which the magnet is located. A structure known as the tower (or turret) extends above the opening, with a tower pipe that serves for filling the tank with liquid helium. The tower pipe transitions into the quench pipe. The diameter of the quench pipe depends on its length and its radius of curvature and is on the order to 20 to 40 cm. The diameter of the tower pipe can be smaller because the helium gas given a quench is still very cold at this point and therefore does not occupy much volume.

A particular danger is that the tower pipe of the magnet is completely sealed by air-ice droplets. Such a sealing can occur due to operating error upon refilling with liquid helium or due to leaks in the system. The seal forms from frozen air that is located in the lower, cold region of the tower. The seal withstands pressures up to several bars, such that the danger exists that the helium tank bursts. Upon a quench of an iced magnet the danger exists of the magnet exploding.

It is therefore vital for a seal in the tower pipe or quench pipe to be immediately remedied. This can ensue by radiant heat or by careful injection of warm helium gas onto the seal, but the magnet must not be caused to quench by the supplied heat. A de-energizing of the magnet is not possible if the pipe is sealed since increased helium is vaporized upon de-energizing, which would increase the pressure in the helium tank.

Detection of a seal in one of the pipes is possible in the prior art only by optical, visual monitoring, i.e. via cameras or other such sensors in the tower pipe as is described in DE 10 2005 058 650 B3, for example. A device for monitoring a tower pipe in a cryomagnet is known from this document, which has at least one monitoring unit that has a functional interaction with a state of the inside of the tower pipe of a cryomagnet to monitor the continuity of the inside of the tower pipe.

A monitoring system for a superconducting magnet as well as a corresponding monitoring method is known from U.S. Patent Application Publication No. 2006/0230769. In this system and method the quantity of liquid helium that is still present and in which the superconducting coil is located is detected. The output unit outputs the monitoring information depending on the detected remaining volume.

The solutions known in the prior art are in need of improvement.

SUMMARY OF THE INVENTION

An object of the present invention to provide a cryostat in which the sealing of filling pipes and exhaust pipes with ice (for example) is immediately communicated.

The invention is essentially based on providing the cryostat with an additional, thin pipe. This auxiliary pipe advantageously runs from the tower of the cryostat over the winding or, respectively, the winding body of the magnet and into the helium tank, wherein it describes a gentle arc around the winding body. In that the auxiliary pipe extends far into the helium tank, the probability is reduced that the pipe ices over since the air ice forms first at the cold points in the system, and that is the lower part of the tower pipe. A pressure sensor is arranged in the auxiliary pipe, which pressure sensor is thus engaged in a communication connection with the inside of the helium tank so that the pressure inside the helium tank can be monitored in this manner with the pressure sensor in the auxiliary pipe.

The cryostat according to the invention, with a tank to accommodate a coolant and at least one superconducting magnet coil to generate a magnetic field—wherein the tank possesses at least one tower pipe on a top side for the filling of the coolant and/or for discharging vaporized coolant—is accordingly characterized by a pressure sensor that is engaged in a communication connection with the inside of the tank via a pressure sensor pipe.

The cryostat advantageously has one or more of the following features:

The pressure sensor pipe and the tower pipe are mutually directed through a tower at the top side of the tank. This has the advantage that the necessary number of openings in the tank is limited to a minimum, and thus the surface across which a heat exchange of the tank with the environment can occur is kept as small as possible.

The pressure sensor pipe extends beyond the tower pipe and into the tank. In particular, the pressure sensor pipe extends beyond the superconducting magnet coil and into the tank and is thereby curved around the superconducting magnet coil. With these embodiments the fact is utilized that the probability that an ice seal forms under the pressure sensor pipe, and therefore that the pressure in the pressure sensor pipe no longer corresponds to the pressure inside the tank, is lower the deeper that the pressure sensor pipe projects into the tank.

A second pressure sensor is provided to detect a pressure difference between the tower and the pressure sensor pipe, wherein the second pressure sensor is arranged in the tower. Both the absolute pressure in the tower and the difference pressure between tower and first pressure sensor can therefore be established.

The pressure sensor pipe is terminated with a pressure sensor pipe seal that breaks upon exceeding a predetermined pressure value, such that the tank can be vented via the pressure sensor pipe and the overpressure can be dissipated. The safety of the cryostat can be additionally improved with this device.

An advantage (among others) of the present invention is apparent in that the most dangerous state of an MR magnet is immediately detected, namely the obstruction of the tower pipe.

DESCRIPTION OF THE PREFERRED EMBODIMENTS

Figure 1:
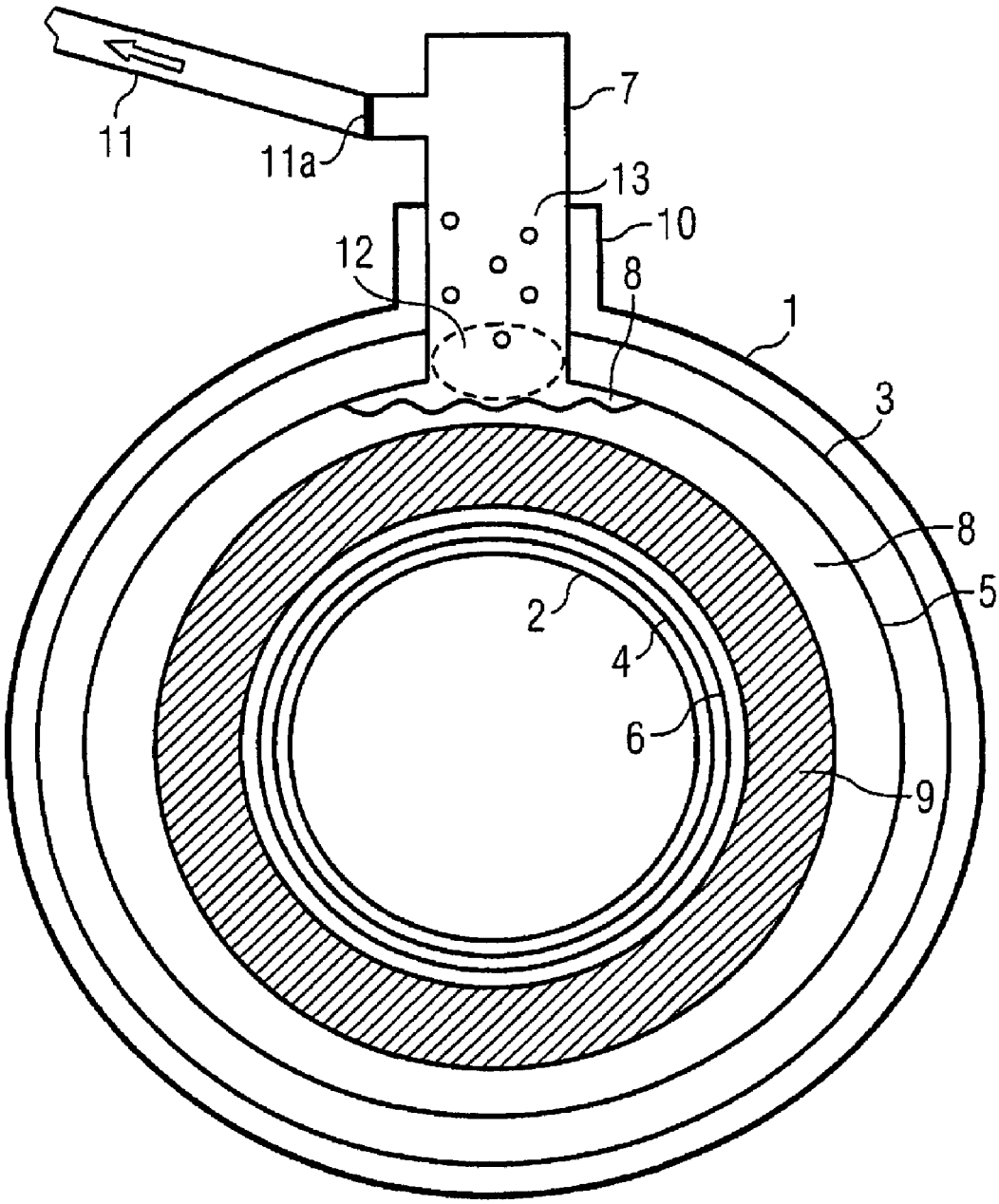
FIG 1 Prior art
FIG. 1 is a schematic cross section through a cryostat according to the prior art for a superconducting magnet.

The drawings are not to scale. Identical or identically operating elements are provided with the same reference characters insofar as it is not noted otherwise.

The invention assumes a bath cryostat. In a bath cryostat, the magnet coil to be cooled is surrounded by coolant. Liquid helium with a boiling point of −268.93° C. or 4.2 Kelvin serves as a coolant. The tank with the magnet coil is normally surrounded with two thermal shields for better thermal insulation.

A schematic cross section through a cryostat for a superconducting magnet is shown in FIG. 1. The cryostat comprises a magnet housing with an outer surface 1 and an inner surface 2. Such a cryostat with superconducting magnet is used, for example, in an MRT apparatus for the generation of the basic magnetic field; the patient (not shown) then lies in the inner chamber that is defined by the inner surface 2 of the housing.

The conductor coils 9 generating the magnetic field are merely schematically indicated and consist of a superconducting material. In order to keep their temperature at a required, low value, they are located in a helium tank filled with liquid helium 8, the outside 5 and inside 6 of which are indicated in FIG. 1. Moreover, an outer radiation shield 3 and an inner radiation shield 4 are provided around the magnet 9. These serve for additional thermal shielding.

The liquid helium 8 is filled into the cryostat via a tower pipe 7 that is directed via a tower 10 into the inside of the cryostat. The tower pipe 7 simultaneously serves for the venting of the cryostat. The tower 10 is arranged on an upward-facing side of the cryostat. The liquid helium 8 essentially entirely fills the helium tank 5, 6; only helium that is located directly at the top side of the helium tank 5, 6 is in the gaseous state. (The vaporized coolant 13 is indicated by a few circles over the liquid surface; the boundary surface between vaporized coolant 13 and liquid coolant 8 is indicated by a wavy line.) The conductor coils 9 inside the helium tank 5, 6 are cooled by the liquid helium 8 to a temperature of 4.2 K. In contrast to this, a temperature that approaches the room temperature prevails in the upper part of the filling nozzle or tower pipe 7.

A quench pipe 11 is connected with the tower pipe 7, which quench pipe 11 establishes a connection between the helium tank 5, 6 and the outside world given a quench of the superconducting magnet 9 so that gaseous helium can escape and an overpressure inside the cryostat does not build. For this it is necessary that both the tower pipe 7 and the quench pipe 11 remain passable. Moreover, the quench pipe 11 is sealed with a burst disc 11*a* so that the helium cannot escape during the normal, disruption-free operation of the superconducting magnet, which burst disc 11*a* breaks in the event of a quench so that the gaseous helium 13 can escape.

Air can get into the tower 10 upon filling the cryostat 1 with liquid helium due to leaks of the quench pipe 11 or the tower 10 and due to inattention. This air can freeze in the lower region of the tower pipe 7—thus in a region where temperatures around 4.2 K predominate—since the melting points of, for example, oxygen or nitrogen are well above 4.2 K. This region is designated with the reference character 12 in FIG. 1. The icing 12 can constrict or entirely seal the free diameter of the tower pipe 7, which under the circumstances represents a great danger, as is briefly explained in the following.

At 4.2 Kelvin liquid helium has a specific weight of 125 kg/m$^3$. Gaseous helium at this temperature has a specific weight of 17 kg/m$^3$. The volume increases by a factor of 7 upon vaporization of the helium, which means a pressure increase to 7 bar given a completely filled and closed vessel. At room temperature, gaseous helium has 700 times the volume of liquid helium. Theoretically, a maximum pressure of a few hundred bar can build in a sealed helium tank at room temperature. In reality, the system follows the complicated laws of thermodynamics: the temperature and the pressure rise only slowly, and the boiling point of the helium increases with the rising temperature and rising pressure up to the maximum temperature of liquid helium (critical point) of 5.2 K. At this point the helium remains gaseous at any pressure.

So that the continuity of the quench pipe 11 as well as of the tower pipe 7 can be monitored quickly and without problems in a simple manner, according to the invention a pressure monitoring unit is provided that interacts with a functional state inside the tower 10 and therefore can monitor the state of the tower pipe 7. The pressure monitoring unit is advantageously arranged at the tower pipe 7. One possible embodiment of the pressure monitoring unit is shown in FIG. 2 and explained in the following.

Figure 2:
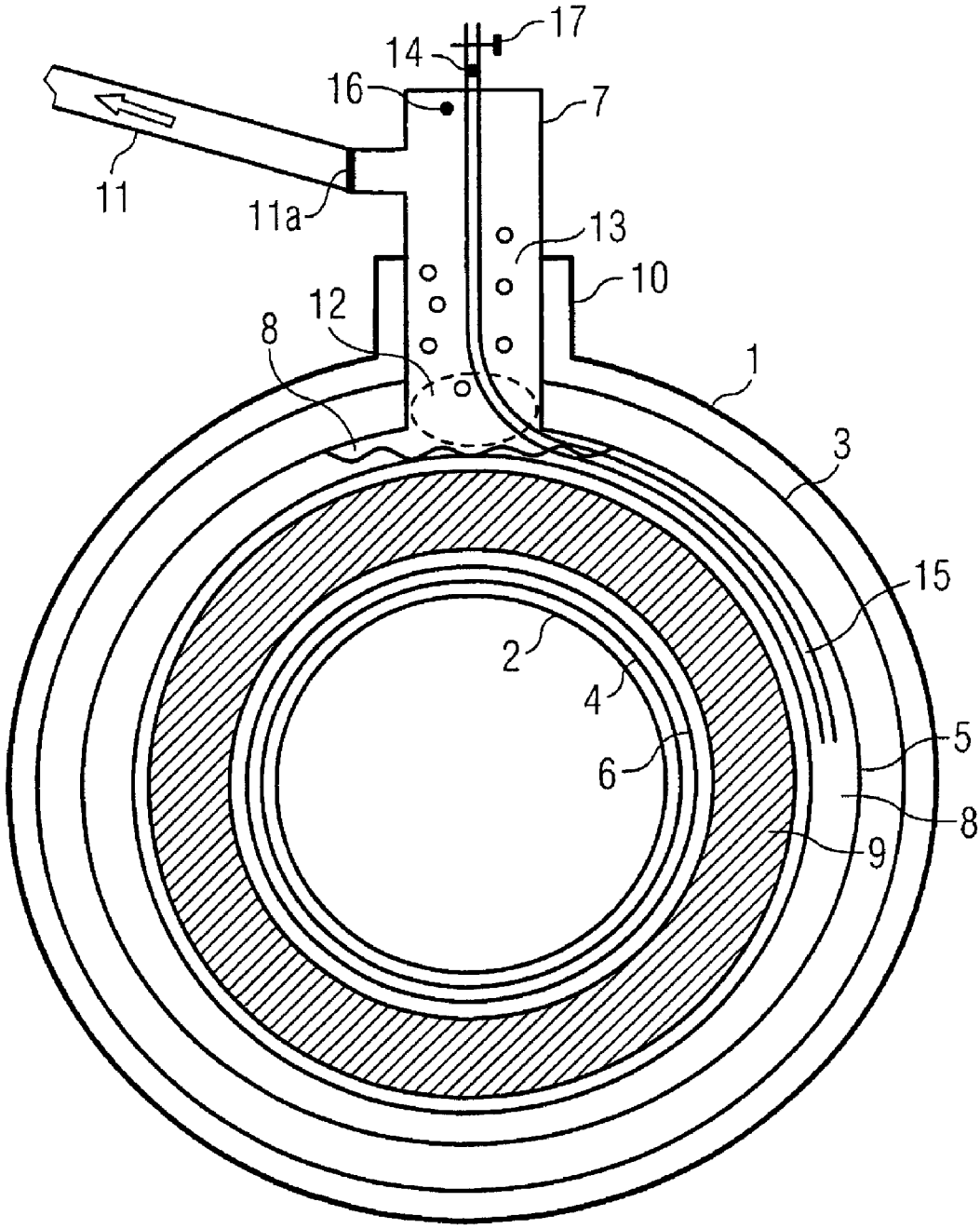
FIG. 2 is a schematic cross section through a cryostat according to the invention for a superconducting magnet.

In the embodiment of the invention according to FIG. 2, the pressure monitoring unit comprises a pressure sensor 14 that is connected via a pressure sensor tube 15 with the inside of the tank 5, 6 in which the superconducting magnet is located. In this way it is ensured that the pressure sensor 14 always indicates the pressure in the chamber of the superconducting magnet, and no falsifications of the measurement values should result. This naturally assumes that the pressure sensor tube 15 is free so that a pressure equalization with the region of the cryostat around the superconducting magnet can actually occur.

The extent that the pressure sensor tube 15 extends into the cryostat depends on, among other things, the probability that the pressure sensor tube 15 is also sealed by air ice or the like. The pressure sensor pipe 15 should therefore advantageously extend beyond the tower pipe 7 into the tank 5, 6. in particular, the pressure sensor pipe 15 should extend beyond the superconducting magnet coil 9 into the tank 5, 6. This is indicated in FIG. 2, where the pressure sensor pip 15 ends with its lower end approximately at the level of the center point of the magnet coil 9 wound in a circle. The pressure sensor pipe 15 must thereby be adapted to the curvature of the superconducting magnet coil 9 around its center point and be curved for its own part. In this way the pressure sensor pipe 15 comes to lie between the coil 9 and the outer surface 5 of the helium tank 5, 6.

In order to keep the number and size of the openings of the cryostat as low as possible, the pressure sensor pipe 15 and the tower pipe 7 advantageously run together through the pipe 10 of the cryostat and penetrate its outer skin 1 on its top side.

In order to detect the pressure differential between the tower pipe 7 and the pressure sensor pipe 15, a second pressure sensor 16 is advantageously provided in the tower pipe 7. The pressure differential between pressure sensor pipe 15 and tower pipe 7 is continually measured with these two pressure sensors 14 and 16. If the pressure differential is different [sic] for a longer period of time, it can be directly concluded that a seal has formed either in the tower pipe 7 or in the pressure sensor pipe 15.

In an additional embodiment of the invention (not shown), it is monitored as to whether a negative pressure relative to atmospheric pressure predominates in the tower pipe 7 or the pressure sensor pipe 15. In this case the danger exists that air is sucked into the tower pipe 7 and that the tower pipe 7 ices over. A slight overpressure should consequently always predominate in the tower. The maintenance of this overpressure can be ensured with a monitoring measurement by the pressure sensors 14 and 16.

If the pressure sensor pipe 15 nevertheless ices over, an opening of the pressure sensor pipe 15 by means of heat is normally only possible if the pressure build-up in the tank has not yet progressed too far. The opening ensues with an electric heater (not shown) that is inserted into the pressure sensor pipe 15, or with warm helium gas (advantageously with a de-energized magnet). The danger thereby exists that a great deal of helium is released, which would increase the pressure in the magnet. A quench could also be triggered. Given a greater pressure build-up in the tank, the pressure sensor pipe 15 can be opened in any state of the magnet with a cutter that is attached to a flexible shaft. If the magnet is energized, the cutter is advantageously anti-magnetic.

Moreover, given a cryostat according to the invention according to a further embodiment (not shown), the pressure sensor pipe 15 is sealed with a pressure sensor pipe seal 17 that breaks upon exceeding a predetermined pressure value so that the tank 5, 6 can be vented via the pressure sensor pipe 15.

Although modifications and changes may be suggested by those skilled in the art, it is the intention of the inventor to embody within the patent warranted hereon all changes and modifications as reasonably and properly come within the scope of his contribution to the art.

I claim as my invention:

1. A cryostat comprising:

a tank comprising at least one superconducting magnet coil that generates a magnet field, and a coolant that circulates in said tank to maintain said superconducting magnet coil in a superconducting state;

said tank having a top side and having a tower pipe located at said top side of said tank having at least one opening communicating with an interior of the tank configured to perform at least one operation selected from the group consisting of filling the tank with said coolant and venting vaporized coolant from the interior of the tank, said tower pipe being subject to blockage; and a pressure sensor, and a pressure sensor pipe placing said pressure sensor in fluid communication with the interior of the tank, said pressure sensor being configured to detect blockage of said tower pipe and to react to detection of said blockage by immediately emitting a signal to an exterior of said tank.

2. A cryostat as claimed in claim 1 comprising a tower located on said top side of said tank, said pressure sensor pipe and said tower pipe proceeding together in said tower.

3. A cryostat as claimed in claim 1 wherein said pressure sensor pipe extends beyond said tower pipe into said interior of said tank.

4. A cryostat as claimed in claim 3 wherein said pressure sensor pipe extends beyond said superconducting magnet coil in said interior of said tank.

5. A cryostat as claimed in claim 4 wherein said pressure sensor pipe curves around said superconducting magnetic coil.

6. A cryostat as claimed in claim 1 wherein said pressure sensor is a first pressure sensor, and comprising a second pressure sensor in said tower pipe configured to detect a pressure differential between said tower pipe and said pressure sensor pipe and to emit a signal to said exterior of said tank indicating said pressure differential.

7. A cryostat as claimed in claim 1 comprising a pressure sensor pipe seal that closes said pressure sensor pipe, said pressure sensor pipe seal being frangible and configured to break upon a predetermined pressure in said tank being exceeded, to vent vaporized coolant via said pressure sensor pipe.

* * * * *